US005302144A

United States Patent [19]

Francois et al.

[11] Patent Number: 5,302,144

[45] Date of Patent: Apr. 12, 1994

[54] CONNECTOR FOR ELECTRICAL CABLES

[75] Inventors: Pierre Francois, Limoges; Robert Battle, Arnac Pompadour, both of France

[73] Assignee: Societe Industrielle de Construction d'Appareils et de Materiel Electrique S.I.C.A.M.E., Arnac Pompadour, France

[21] Appl. No.: 64,571

[22] Filed: May 20, 1993

[30] Foreign Application Priority Data

Jun. 30, 1992 [FR] France ..... 92 08035

[51] Int. Cl.[5] ..... H01R 4/24; H01R 4/70

[52] U.S. Cl. ..... 439/781; 439/271; 439/413

[58] Field of Search ..... 439/271, 412, 413, 411, 439/272, 273, 781, 782

[56] References Cited

U.S. PATENT DOCUMENTS 4,643,512 2/1987 Prodel ..... 439/781
4,985,003 1/1991 Francois et al. ..... 439/781

FOREIGN PATENT DOCUMENTS 2566191 12/1985 France .
2601516 1/1988 France .
2634070 1/1990 France .

*Primary Examiner*—Gary F. Paumen
*Attorney, Agent, or Firm*—Young & Thompson

[57] ABSTRACT

An electrical cable connector comprises at least two insulative material jaw members adapted to define between them at least two parallel channels, one for each cable. At least one metal contact member is carried by one of the jaw members in a housing in which it is at least partially accommodated. It has active parts at the front adapted to intersect both channels. Clamping means close the jaw members so as to close the channels onto the cables. Insulative material seals are disposed around the respective active parts of the contact member and linked by a crosspiece. The crosspiece is secured by deformation to the respective jaw member so that it is fastened thereto. To this end the crosspiece is disposed between two ribs which are one piece with the jaw member and are deformed under pressure into a U-shape pressing against the crosspiece.

9 Claims, 2 Drawing Sheets

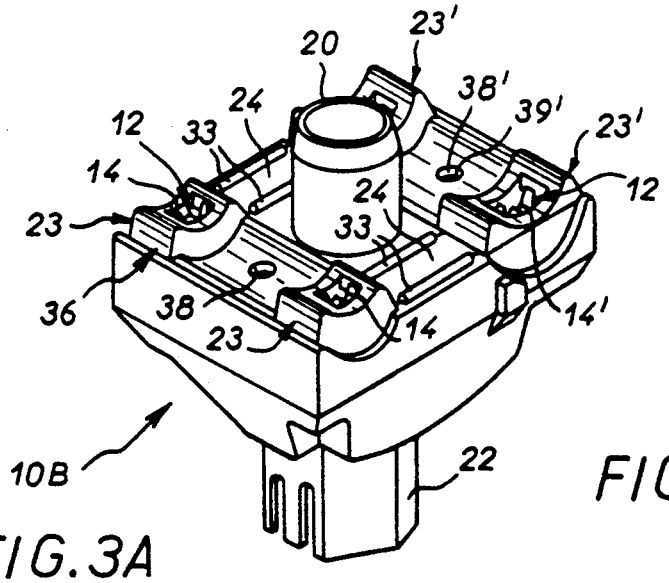
FIG. 2
FIG. 3
FIG. 3A
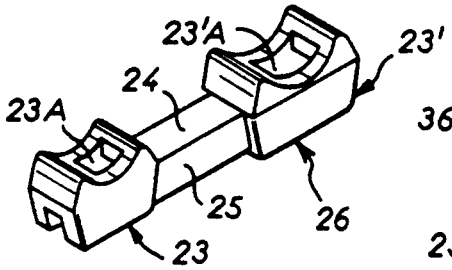
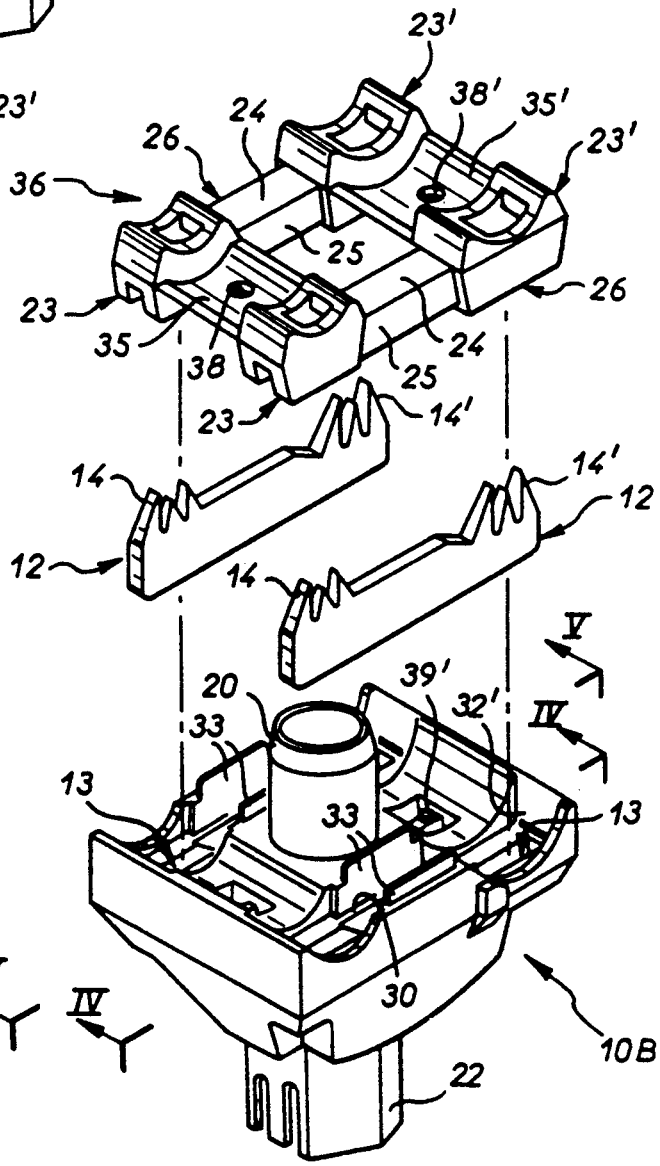
FIG. 1
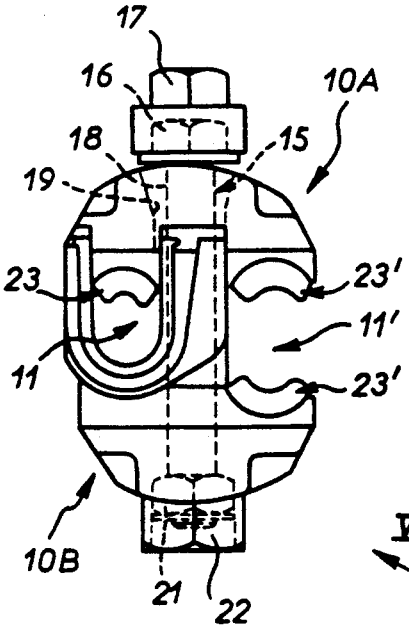

CONNECTOR FOR ELECTRICAL CABLES

BACKGROUND OF THE INVENTION

1. Field of the invention

The present invention concerns connectors for electrical cables comprising at least two jaw members made from a hard insulative material such as polyamide 6 charged 50% with glass fibers so that they are rigid, adapted to define at least two parallel channels between them, one per electrical cable, at least one metal contact member, preferably of aluminum alloy or tinned brass, carried by one of said jaw members, at least partly contained within a housing in the latter and having active parts at the front forming perforating teeth intercepting both of said channels to establish a bridge connection between the electrical cables, and clamping means adapted to move the jaw members towards each other to close said channels onto said electrical cables.

It is more particularly directed to the case where insulative material seals are provided on the active parts of the contact member (or each contact member where a plurality of contact members are employed), to be more precise soft insulative material (i.e. flexible and elastic thermoplastic material) seals surrounding or substantially surrounding said active parts to protect them more reliably from moisture when they are fitted to the electrical cables.

This is the case in the disclosures of French patent No. 2 601 516, which is a patent of addition to an earlier French patent application (84 09384) which has an equivalent U.S. Pat. No. (4,643,512), and French patent No. 2 634 070.

In the first of these documents the two seals for the active parts of the same contact member are joined together by a crosspiece.

They are portions of an inverted gusset sealing part which caps the exterior part of the contact member with which it is engaged in the respective housing of the respective jaw member, with sealing beads around the perforating teeth of this contact member.

However carefully it may be fitted, in practise this sealing part is not finally located until the connector is first clamped to the electrical cables.

In the second document the seals are overmolded continuously with a skin covering virtually all of the surface of the contact member.

In another connector currently marketed by the assignees of this application the contact members are simple blade members force-fitted into "ad hoc" grooves in the insulative jaw or jaws, after which a soft and durably elastic synthetic material is injected into all of the empty spaces between the blade members and the jaw members, such injection simultaneously producing sealing beads all around the perforating teeth, as claimed, described and/or shown in the aforementioned prior art documents, of which the assignee of this application is the proprietor.

In this latter product, in the "inverted gusset" solution of French patent 2 601 516 and in French patent 2 634 070, although an effective seal is provided between the perforating teeth and the cables to be connected by the sealing beads around said perforating teeth when the connector is clamped onto the cables, the sealing is less effective during such clamping between the crosspiece joining the beads and the contact member and between the latter and the groove for receiving it in the clamping jaw member. This is because of the restricted clamping upon assembly in the factory and also because the clamping is not applied directly to the crosspiece or the beads.

An object of the present invention is to improve sealing by hot deforming said crosspiece under pressure in the factory to deform it into contact with ribs which are in one piece with the insulative jaw member. Initially vertical, these ribs are heated and bent under pressure to a position at 90° to their initial position, becoming embedded in the crosspiece and applying thereto an elastic compressive force producing a perfect seal between the crosspiece and the contact member and between the crosspiece and the insulative jaw member. This is achieved at the factory and is independent of the clamping of the connector when it is fitted to the cables to be connected.

Note that this new method constitutes an improvement on the solutions disclosed in the patents or patents of addition of the assignee of this application and may be applied to the latter solutions subject to modifications of the clamping jaw members in the manner described in this application.

SUMMARY OF THE INVENTION

The present invention consists in an electrical cable connector comprising at least two insulative material jaw members adapted to define between them at least two parallel channels, one per electrical cable, at least one metal contact member carried by one of said jaw members in a housing in which it is at least partially accommodated and having active parts at the front adapted to intersect both said channels, clamping means adapted to close said jaw members so as to close said channels onto said electrical cables, and insulative material seals disposed around the respective active parts of the contact member and linked by a crosspiece secured to the respective jaw member by deformation thereof so that it is fastened thereto.

The crosspiece, preferably extends alongside at least one rib which is one piece with the jaw member and adapted to be pressed against the crosspiece by deformation, for example. In practise it extends in this way between two parallel ribs which are both deformed into contact with it.

This crimping, carried out in the factory, has the advantage of producing a perfect seal for the contact member before subsequent clamping of the connector (i.e. before the connector is used).

The features and advantages of the invention will emerge from the following description given by way of example with reference to the appended diagrammatic drawings.

BRIEF DESCRIPTION OF THE DRAWINGS

FIG. 1 is a view in elevation of a connector in accordance with the invention.

FIG. 2 is a view in perspective of the one of the jaw members that it comprises to which are fitted two metal contact members and associated seals.

FIG. 3 is an exploded perspective view of the assembly prior to fitting the metal contact members and their seals.

FIG. 3A is a perspective view of a single-piece inverted gusset seal adapted to accommodate a metal contact blade member, this seal being similar to that disclosed in French patent No. 2 601 516.

DETAILED DESCRIPTION OF THE INVENTION

Figure 4:
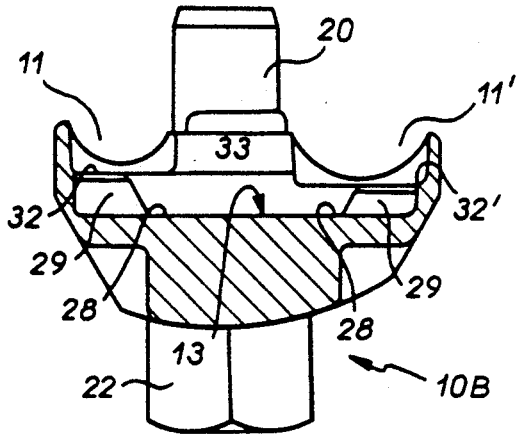
FIGS. 4 and 5 are views of the jaw member shown in FIG. 2 and 3 in transverse cross-section on the respective lines IV—IV and V—V in FIG. 3.
Figure 5:
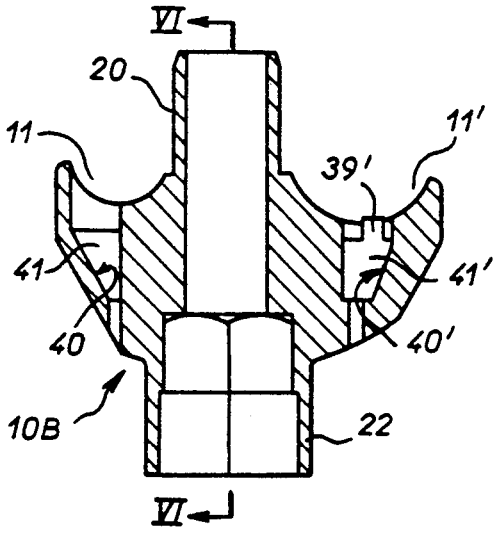
Figure 6:
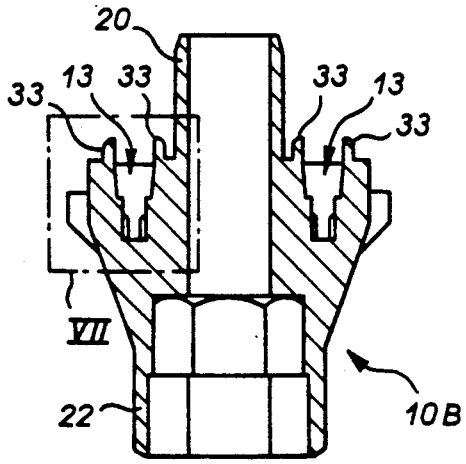
FIG. 6 is a view of this jaw member in transverse cross-section on the line VI—VI in FIG. 5.

The figures show by way of example the application of the invention to a branch connector of the type disclosed in the previously mentioned French patent No. 2 634 070.

For this reason the connector will not be described in complete detail here.

Only the parts needed to understand the invention will be described.

The overall aim is to connect together two electrical cables (not shown) which may be insulated electrical cables, although this is not mandatory. The connector in accordance with the invention therefore comprises two jaw members 10A, 10B made from a hard (i.e. rigid) insulative material and adapted to define between them two parallel channels 11, 11', one per electrical cable.

The connector further comprises at least one metal contact member 12 carried by one of the jaw members 10A, 10B and at least partially accommodated in a housing 13 in the latter. It has active parts 14, 14' facing forwards which intercept both the channels 11, 11' at the inside surface of the jaw member 10A, 10B.

Each of the jaw members 10A, 10B carries two parallel contact members 12 in the form of simple elongate plates or blades the active parts 14, 14' of which form teeth for perforating the insulation of the electrical cables to be connected.

Only the features of the contact member 12 carried by the jaw member 10B are described hereinafter, it being understood that the same type of features are preferably adopted on the jaw member 10A.

The connector further comprises clamping means adapted to close the jaw members 10A, 10B in order to close their channels 11, 11' onto the electrical cables to be connected.

In a manner that is known in itself, the clamping means comprise a single screw 15 whose head 16 has an actuator termination 17 at the top, which bears on the outside of the jaw 10A, and whose shank 18 passes in succession through an oblong opening 19 in the jaw member 10A and a well 20 in the jaw member 10B before it is screwed into a nut 21 beyond the jaw member 10B and accommodated in a well 22 which is in one piece with the latter.

The screw 15 is operative between the two contact members 12 of the jaws 10A, 10B.

Seals 23, 23' are fitted to the respective active parts 14, 14' of a contact member 12. They are made from a soft (i.e. flexible and elastic) insulative material, fit as closely as possible around the active parts 14, 14' and are joined together by a crosspiece 24.

In a manner similar to that described and shown in French patent No. 2 601 516, the seals 23, 23' are shaped like cradles for optimum application to the electrical cables to be connected and have openings 23A, 23'A at the front through which the active parts 14, 14' that they surround pass.

The crosspiece 24 which links the seals 23, 23' is bordered at the sides by two flanges 25 continuous with it and which flank the contact member 12 as closely as possible over at least part of its height.

The combination of the two seals 23, 23' associated with a contact member 12, the crosspiece 24 linking them and the flanges 25 at the sides of the crosspiece 24 together constitute an inverted gusset type seal 26 which caps the exterior part of the contact member 12 and is inserted with the contact member 12 in the respective housing 13.

The housing 13 is a blind groove.

Figure 7:
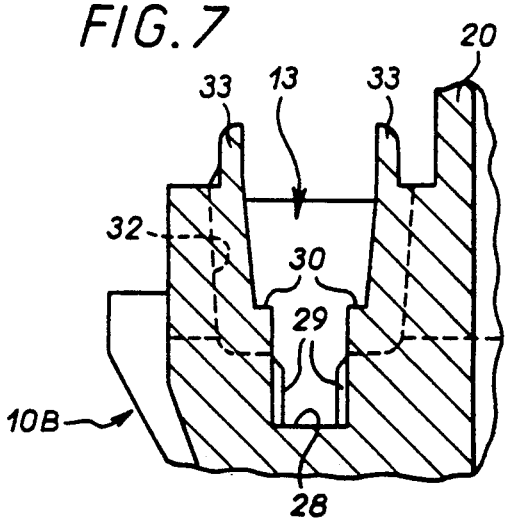
FIG. 7 shows to a larger scale that part of FIG. 6 identified by a frame VII.

At its ends it has bosses 29 projecting from its sides, starting at its back 28 (see FIGS. 4 and 7) and between which the interior part of the contact member 12 is inserted.

It further comprises shoulders 30 between its ends, parallel to and spaced from its back 28, against which the edge of the flanges 25 flanking the crosspiece 24 bear.

Finally, it has enlarged end portions 32, 32' for accommodating the seals 23, 23'.

According to the invention the crosspiece 24 linking the seals 23, 23' is crimped to the jaw member B, so that it is fastened to it, and it is preferably stressed elastically during subsequent crimping.

To, this end it extends alongside at least one rib 33 which is one piece with the jaw member 10B, and, therefore of the same material as the latter, rib 33 being deformed to press it against the crosspiece 24.

In this example the crosspiece 24 extends between two parallel ribs 33 which flank the median part of the housing 13.

Each of the ribs 33 is in corresponding relationship to a shoulder 30 of the jaw member 10B.

Each of the ribs 33 is adapted t be bent over into a U-shape so that it presses elastically against the crosspiece 24 with its end anchored in it.

This deforming is carried out under pressure in the factory, with the application of heat or ultrasound, for example.

The ribs 23 are relatively thin tongues and are initially straight (see FIGS. 3 through 7 and 8A).

Figure 8A:
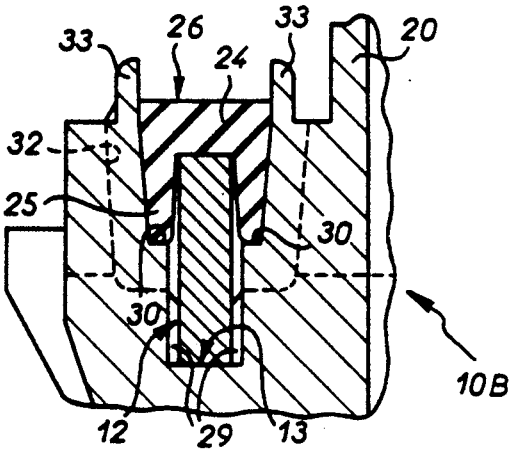
FIGS. 8A and 8B are partial views in transverse cross-section which, like that of FIG. 7, show two successive phases of the fitting of a contact member and associated seals and crimping of the latter.
Figure 8B:
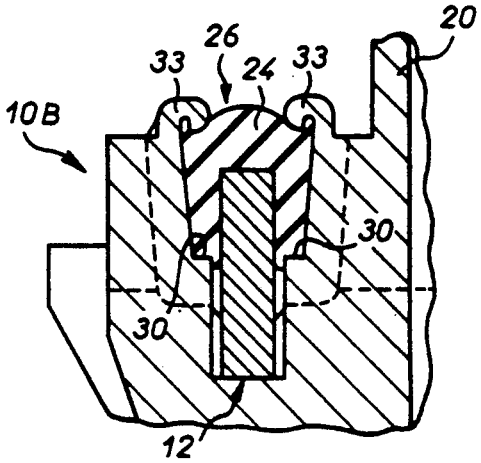

After fitting the contact member 12 and the sealing member 26 which comprises the associated seals 23, 23' and the crosspiece 24 linking the seals 23, 23', the ribs 33 are deformed in order to apply an elastic compressive force to the crosspiece 24 (FIG. 8B).

The ribs 33 then press the crosspiece 24 strongly against the edge of the contact member 12 and against the shoulders 30 of the jaw member 10B.

In the embodiment shown in FIG. 3A each of the sealing members 26 constitutes an individual part which is manipulated and fitted separately.

As a preferable alternative to this, however, and as shown in FIGS. 2 and 3 the seals 23, 23' of these sealing members 26 are joined together by longitudinal members 35, 35' so that they together constitute a rectangular frame-shaped sealing member 36 at whose four corners they are respectively disposed.

This simplifies manipulation of the assembly.

The well 20 is accommodated in a central opening in the sealing member 36.

The longitudinal members 35, 35' are in the form of cradles, like the seals 23, 23' that they join.

At least one of the longitudinal members 35, 35' (the longitudinal member 35' in this example) is preferably secured by deformation to the jaw member 10B in order to prevent it lifting on insertion of the main (i.e. through) cable into the channel 11'.

To this end the longitudinal member 35' has a hole 38' in it through which a pin 39' passes. This pin is in one piece with the jaw member 10B, and therefore of the same material as the latter, and is pressed against the member 35' by peening it over.

This is done at the same time and in the same way as the deforming of the ribs 33.

The longitudinal member 35 also has a hole 38 in it in this example.

It can therefore be secured by deformation to the jaw member 10B if required.

Each of the jaw members 10A, 10B has in line with the channels 11, 11' at least one hole 40, 40' through it and through which the channel 11, 11' communicates with the outside.

For each channel 11, 11' there are two holes 40, 40' which are parallel and on either side of a partition 41, 41' which carries the respective pin 39' on the same side as the longitudinal member 35'.

The holes 40, 40' are between and spaced from the contact members 12.

Their function is to evacuate any water which may enter the connector between the contact members 12.

This advantageously prevents bursting of the connector in frost.

It must be emphasized that any water entering the connector does not compromise its insulating qualities as it cannot reach the contact members 12 because of the seals 23, 23' associated with each contact member 12 and the crosspieces 24, secured in accordance with the invention, linking the seals 23, 23'.

The present invention is naturally not limited to the embodiments described and shown but encompasses any variant execution and/or combination of its various component parts.

Specifically, the connector in accordance with the invention may comprise more than two jaw members.

Also, applications of the invention are not restricted to the connector specifically described and shown.

To the contrary, these applications encompass the connectors described in the French and U.S. patents and patents of addition of the assignee of this application and the connector currently marketed by said assignee, as mentioned in the preamble of this disclosure.

Moreover, applications of the invention are not restricted to branch connectors for insulated electrical cables, but encompass other types of connector.

There is claimed:

1. Electrical cable connector comprising at least two insulative material jaw members adapted to define between them at least two parallel channels, one per electrical cable, at least one metal contact member carried by one of said jaw members in a housing there of in which is at least partially accommodated and having active parts at its front adapted to intersect both said channels, clamping means adapted to close said jaw members so as to close said channels onto said electrical cables, and insulative material seals disposed around the respective active parts of said contact member and linked by a crosspiece which is secured to the respective jaw member be deformation thereof so that it is fastened thereto.

2. Connector according to claim 1 wherein said crosspiece is adapted to lie alongside at least one rib which is one piece with said jaw member which is adapted to be deformed against it.

3. Connector according to claim 2 wherein said rib is deformed by bending it over into a U-shape pressing against said crosspiece.

4. Connector according to claim 3 wherein said crosspiece is made from a soft synthetic material and the end of said rib is anchored in it after said deforming.

5. Connector according to claim 2 wherein said crosspiece is adapted to lie between two said ribs.

6. Connector according to claim 1 wherein said crosspiece has at its lateral edges two flanges, each continuous with said seals and each in corresponding relationship to a respective said rib, adapted to flank as closely as possible said contact member over a part of the height of the latter and to bear at their edge on shoulders of said jaw member.

7. Connector according to claim 1 wherein a said jaw member carries two parallel contact members and the seals of said contact members are linked by longitudinal members so that they conjointly form a frame-shaped sealing member.

8. Connector according to claim 7 wherein at least one of said longitudinal members is adapted to be deformed to the respective jaw member.

9. Connector according to claim 8 wherein a pin passes through a hole in said longitudinal member and is in one piece with said jaw member against which it is adapted to be pressed by peening it over.

* * * * *